United States Patent [19]

Boo

[11] Patent Number: 4,836,787

[45] Date of Patent: Jun. 6, 1989

[54] CONSTRUCTION KIT EDUCATIONAL AID AND TOY

[76] Inventor: William O. J. Boo, Box 714, University, Miss. 38677

[21] Appl. No.: 847,403

[22] Filed: Apr. 1, 1986

[51] Int. Cl.[4] ..... A63H 33/04

[52] U.S. Cl. ..... 434/403; 52/DIG. 10; 52/DIG. 13; 446/108; 446/114

[58] Field of Search ..... 52/DIG. 10, DIG. 13; 446/85, 108, 109, 114, 116, 901; 273/DIG. 30; 434/403

[56] References Cited

U.S. PATENT DOCUMENTS

| | | | |
|---|---|---|---|
| 1,620,574 | 3/1927 | Savage | 446/85 |
| 1,894,061 | 1/1933 | Sanders | 446/114 |
| 2,839,841 | 6/1958 | Berry | 434/278 |
| 3,117,384 | 1/1964 | Billis | 434/208 |
| 3,614,835 | 10/1971 | Rice et al. | 434/211 |
| 3,659,360 | 5/1972 | Zeischegg | 434/403 |
| 3,726,027 | 4/1973 | Cohen et al. | 434/98 |
| 3,921,312 | 11/1975 | Fuller | 434/96 |
| 4,271,566 | 6/1981 | Perina | 24/204 |
| 4,309,852 | 1/1982 | Stolpin | 52/81 |
| 4,462,193 | 7/1984 | Ericson | 52/282 |
| 4,479,651 | 10/1984 | LaFleur | 273/157 R |
| 4,536,995 | 8/1985 | Frederick | 52/27 |
| 4,685,892 | 8/1987 | Gould et al. | 446/109 |

FOREIGN PATENT DOCUMENTS

| | | | |
|---|---|---|---|
| 2733708 | 2/1979 | Fed. Rep. of Germany | 446/901 |
| 2846666 | 5/1980 | Fed. Rep. of Germany | 446/116 |
| 1300206 | 6/1962 | France | 446/901 |
| 7300610-8 | 12/1974 | Sweden | 52/DIG. 13 |
| 160228 | 3/1921 | United Kingdom | 446/116 |
| 2082925A | 3/1982 | United Kingdom | 446/901 |

*Primary Examiner*—Henry E. Raduazo

*Attorney, Agent, or Firm*—Ward Brown; Robert W. Beach

[57] ABSTRACT

Sheet material building components or units in the shape of different regular polygons of equal edge length have strips of hook-and-pile fastening materials permanently secured so as to extend along their side edges. Hook type fastening material is disposed toward one end portion of each side edge and pile type fastening material is disposed toward the other end portion of each side edge. The strips of hook type and pile type fastening materials alternate around the circumference of each unit. Different units can be connected substantially edge-to-edge by simply placing the desired edges in contact to form a wide variety of two-dimensional or three-dimensional arrays or shapes.

3 Claims, 3 Drawing Sheets

CONSTRUCTION KIT EDUCATIONAL AID AND TOY

BACKGROUND OF THE INVENTION

1. Field of the Invention

The present invention relates to an amusement device, toy or educational aid of the general type having several sheet material building components or units of common geometric shapes with mechanism for connecting the units substantially edge-to-edge in a two-dimensional or three-dimensional array.

2. Prior Art

Regular polygons are nature's building blocks in forming tesselations, polyhedra and packed polyhedra.

"Stick-and-connector" construction kits have been used to form space frameworks representing naturally occurring lattice structures and other geometrical forms, but it can be difficult for the novice to visualize the symmetrical pattern of these forms by viewing a stick-and-connector framework.

Zeischegg U.S. Pat. No. 3,659,360, issued May 2, 1972, Berry U.S. Pat. No. 2,839,841, issued June 24, 1958, and Billis U.S. Pat. No. 3,117,384, issued Jan. 14, 1964, disclose construction kits of another general type, namely, kits using three-dimensional blocks which are intended to be arranged with adjacent side faces of the blocks in substantially contiguous relationship. Such blocks also have been used to represent lattice structures of crystalline solids and other shapes and forms, but there are limitations on the number of possible arrangements so that such kits are not sufficiently versatile to be interesting and amusing over a long period.

Another general category of construction kits is illustrated by Rice et al. U.S. Pat. No. 3,614,835, issued Oct. 26, 1971, and Cohen et al. U.S. Pat. No. 3,726,027, issued Apr. 10, 1973. Kits of this category have planar sheet material components with mechanism for joining the components edge-to-edge. The present invention is an improved kit of this general category.

SUMMARY OF THE INVENTION

The principal object of the present invention is to provide an improved novel construction kit of the type having sheet material building components joinable substantially edge-to-edge, usable to construct a wide range of two-dimensional and three-dimensional arrays as limited only by the imagination of the user, for use as an educational aid or simply for amusement, of uncomplicated and inexpensive, but durable, construction and easy to use.

In the preferred embodiment of the present invention, the foregoing object is accomplished by a construction kit having several of each of a plurality of different regular polygonal units formed of sheet material and having edges of the same length, and complementary connectors, such as hook-and-pile fastening strips, on portions of each edge and alternating around the circumference of each unit. Preferably, the strips of fastening materials are wrapped around the edges and the top and bottom margins of the sheet faces adjacent to such edges. Each strip of fastening material extends approximately from the center of its side edge outward to a corner. The result is that adjacent pieces can be connected substantially edge-to-edge by simply pressing the complemental edges together.

DETAILED DESCRIPTION

Figure 1:
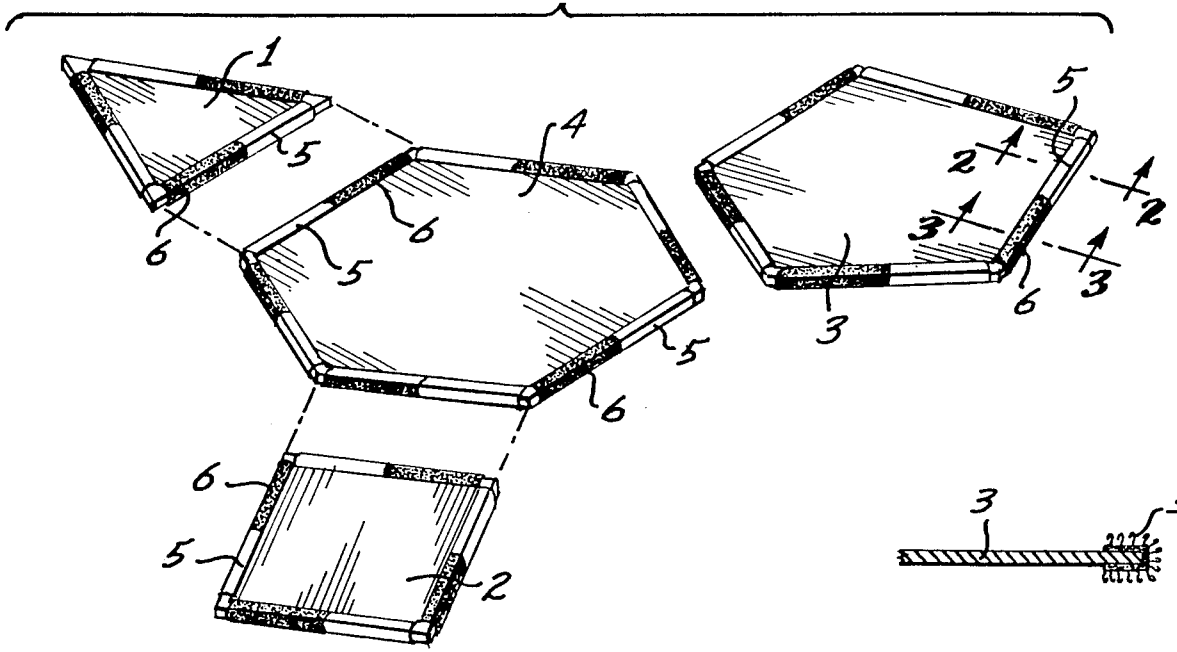
FIG. 1 is a diagrammatic top perspective of representative components of a construction kit educational aid and toy in accordance with the present invention illustrating only one of each shape of sheet material building unit provided in such kit.

The construction kit educational aid and toy in accordance with the present invention consists of several sheet material building components or units such as units 1, 2, 3 and 4 shown in FIG. 1. Each unit is formed primarily of a suitable rigid or substantially rigid sheet material such as plastic or cardboard and has a continuous circumferential edge defining a common two-dimensional geometric shape, preferably but not necessarily a regular polygon. Unit 1 is in the shape of an equilateral triangle, unit 2 is in the shape of a sqaure, unit 3 is in the shape of a regular pentagon and unit 4 is in the shape of a regular hexagon. The edges of the different units are of equal length and incorporate mechanism for joining the units substantially edge-to-edge. A representative kit would have several units of each shape.

As thus far described the present invention is not unobviously novel. U.S. Pat. Nos. 3,614,835 and 3,726,027, for example, show sheet material units of regular polygonal shape connected edge-to-edge. In the construction shown in U.S. Pat. No. 3,614,835, however, the units are permanently joined by adhesive tape. In the construction shown in U.S. Pat. No. 3,726,027, separate connectors are used, either in the form of tubes or bars with longitudinal slots into which the marginal portions of the sheet material units are fitted or in the form of flat bridging strips and small pins to connect the strips to the units. The small separate connectors can be difficult to manipulate, requiring more dexterity and patience than a grade schooler may have, and can be easily lost or misplaced, and even could be dangerous to an infant or toddler. The known separate connectors also can require precise positioning of the units to be connected, may be connect the units securely and may limit the included angles at which units can be connected.

In contrast, the units in accordance with the present invention are designed to be connected edge-to-edge by simply placing the desired edges in contact. A secure connection is achieved which, nevertheless, can be severed easily manually by pulling the connected units apart. Precise positioning of the units to be joined is not required. There is no limitation on the included or dihedral angles at which adjacent units can be connected. Some swinging movement of connected units is possible which is of great assistance particularly when three-dimensional objects are being formed. Any edge of any unit can be connected to any edge of any other unit. No separate connectors are required.

Figure 2:
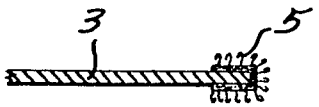
FIG. 2 is a diagrammatic fragmentary section along line 2—2 of FIG. 1.
Figure 3:
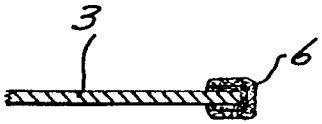
FIG. 3 is a diagrammatic fragmentary section along line 3—3 of FIG. 1.

As shown diagrammatically in FIG. 1 and as better seen in FIGS. 2 and 3, each sheet material building unit of the kit in accordance with the present invention has complementary fasteners, preferably complementally adherent strips 5 and 6 of hook-and-pile fastening materials permanently secured along each of its circumferential side edges. The fastener of one type is positioned over one half portion of each edge and the fastener of the complementary type is positioned in the other half portion of such edge. For example, in the illustrated embodiment of FIG. 1, strips 5 are hook type fastening material which extend along approximately one-half of each of the edges and strips 6 of pile or loop fastening material, diagrammatically indicated as the darker strips, extend along approximately the other one-half of each of the edges. Preferably, each strip is return bent and wrapped around the margins of the unit faces adjacent to such edge and sufficiently wide that the fastening material extends along the top and bottom circumferential margins of the unit faces in addition to along the edges. The fastening strips of different but complementally adherent materials alternate around the circumference of each building unit.

As indicated in FIG. 1, despite the differences in types of polygons, the straight peripheral edges of all of the polygon sheets are of equal length. Each sheet edge carries a first type of component, such as the pile componenets 6, on one half and a second type of component, such as the hook strips 5, on the other half which complemental first type of components and second type of components, such as hook and pile components, are cooperatively adherent, but the first type of components, such as the pile components 6, are not cooperatively adherent with each other nor are the second type of components, such as the hook components 5, cooperatively adherent with each other.

As apparent from the edge adjacent arrangement shown in FIG. 1, each building unit can be connected edge-to-edge to any of the other building units by simply bringing the desired edges together so that the strip 5 of hook type fastening material from one unit comes into contact with the strip 6 of pile or loop type fastening material of the desired edge of the other unit, and vice versa. The connection is secure but still allows for relative swinging movement of the two units and can be broken by simply pulling the units apart. In addition, the connection is still made even if the two units are brought together without the desired edges being precisely in registration, such as if they overlap slightly or are tilted slightly relative to each other. Further, the included angle or dihedral angle defined by the two units as they are brought together does not affect the making of the connection because the connection is made even if only the portions of the strips extending along the margins of the top or bottom surfaces are brought into contact.

Nevertheless, whether or not the connection is made is affected by the relative orientation of the units to be joined, that is, whether or not complemental components of the sheet material units are matching. For example, the units shown in FIG. 1 are arranged with corresponding edges in registration so that adjacent units can be connected to each other by simple translation with or without angular displacement. If any of the units is flipped over from the position shown in FIG. 1, that unit no longer could be connected in registered edge-to-edge relationship with another unit because each of its strips 5 or 6 of fastening material would be positioned to contact the strips of the same type of fastening material on each edge of the other units when edges of different units were registered. Preferably, corresponding surfaces of the different units will be color-coordinated or otherwise coded so that the proper orientation of units to be joined is immediately apparent.

Figure 4:
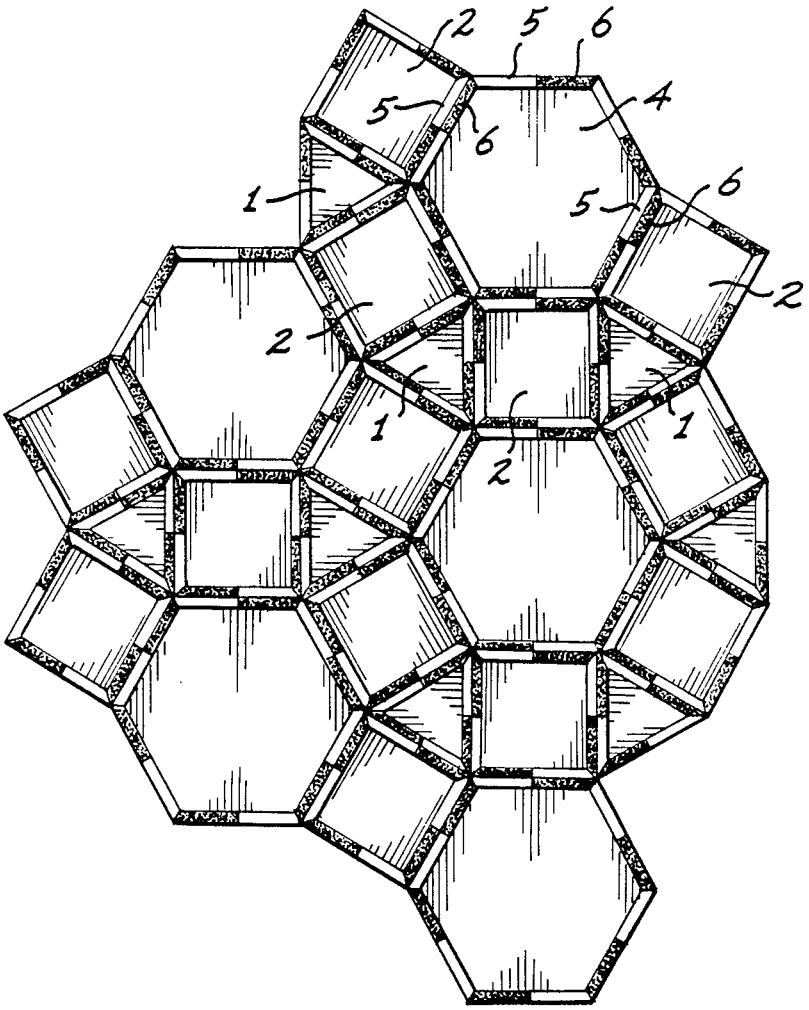
FIG. 4 is a diagrammatic top plan of a representative two-dimensional or coplanar array that can be formed by a construction kit in accordance with the present invention.

The sheet material units can be joined in a wide variety to two-dimensional or coplanar arrays. FIG. 4 illustrates an array using equilateral triangular units 1, square units 2 and regular hexagonal units 4. The two-dimensional array selected can represent a section of the lattice structure of a specific crystalline solid for educational purposes or it can be an array created solely at the whim of the user. For the units to be connected with their edges in registration, however, it is required that corresponding surfaces of all units face in the same direction.

Figure 5:
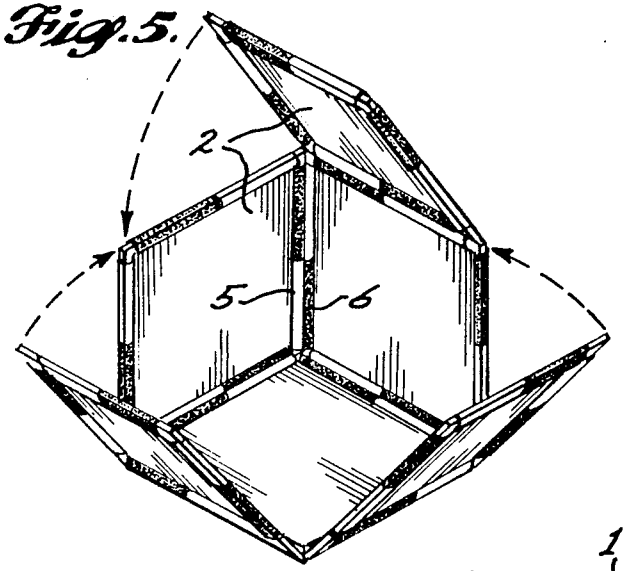
FIG. 5 is a diagrammatic top perspective of a first three-dimensional object in the process of being constructed by use of the construction kit in accordance with the present invention.
Figure 6:
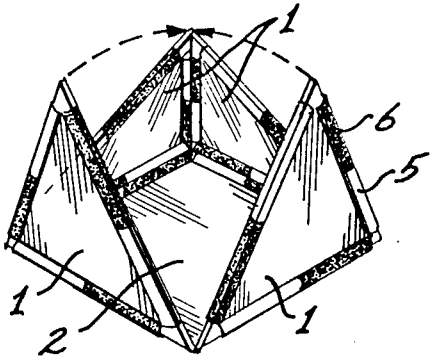
FIG. 6 is a diagrammatic top perspective of a second three-dimensional object in the process of being constructed by use of the construction kit in accordance with the present invention.

Alternatively, a wide variety of three-dimensional arrays or geometric shapes can be created. FIG. 5 illustrates formation of a cube by six square units 2. FIG. 6 illustrates formation of a square pyramid by a square unit 2 at the base and four equilateral triangular units 1 at the sides. The angular orientation of the units being connected need only roughly approximatel the finished angular orientation because the hook-and-pile fastening strips allow the units to be swung relative to each other even after connection, as diagrammatically indicated by the broken line arrows in FIGS. 5 and 6.

Figure 7:
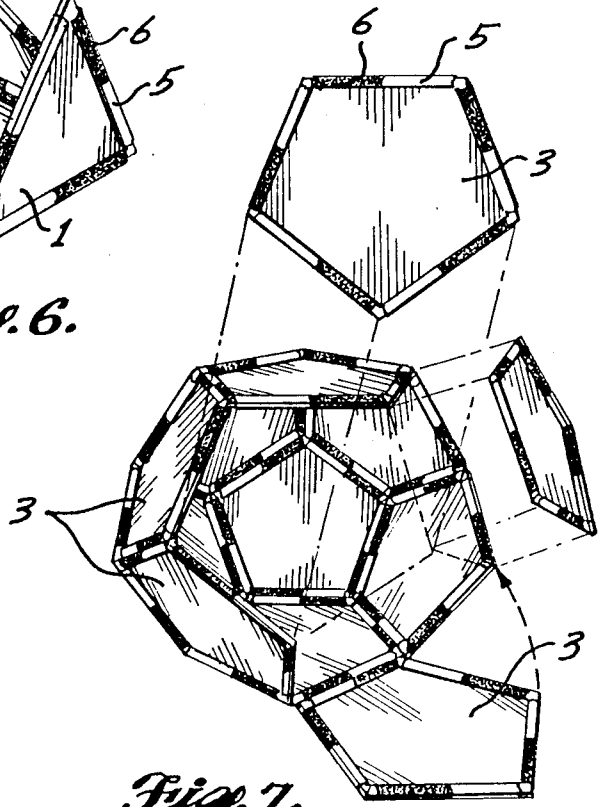
FIG. 7 is a diagrammatic top perspective of a third three-dimensional object in the process of being constructed by use of the construction kit in accordance with the present invention.
Figure 8:
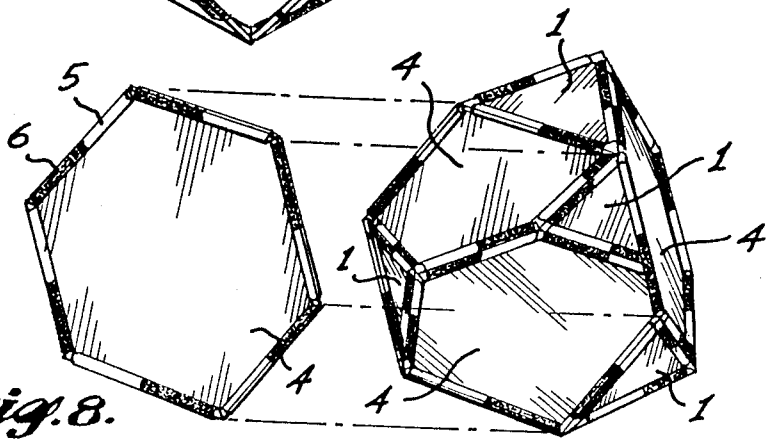
FIG. 8 is a diagrammatic top perspective of a fourth three-dimensional object in the process of being constructed by use of the construction kit in accordance with the present invention.

FIG. 7 shows a more complicated three-dimensional shape or polyhedron under construction using only regular pentagonal units 3, and FIG. 8 shows another more complicated three-dimensional shape or polyhedron in the process of construction with equilateral triangular units 1 and rgular hexagonal units 4. For three-dimensional shapes such as those shown in FIGS. 5 through 8, corresponding surfaces of the individual units must face each other, which is made easier if the faces are color-coordinated or otherwise coded.

As an educational aid, the construction kit in accordance with the present invention immediately illustrates the relationship between various common geometric shapes, can increase the user's skills of spatial conception and can be used to teach the lattice structure of various crystalline solids and the geometric shapes of some microscopic organisms, but in a manner which is fun and interesting for the user regardless of age.

I claim:

1. A construction kit comprising several planar sheets of regular polygonal shape each having respective top and bottom surfaces, each of said sheets having straight peripheral edges of equal length and each of said edges having an elongated strip of a first type of fastening material wrapped around such edge and extending along such edge and along marginal portions of the top and bottom surfaces of its sheet from one end of such edge to approximately the center of such edge, each of said edges further having an elongated strip of a second type of fastening material, different from said first type, wrapped around such edge and extending along such edge and along marginal portions of the top and bottom surfaces of its sheet from the other end of such edge to approximately the center of the edge so that all of said sheet edges are alike, said first and second types of fastening material being complementally adherent so as to be manually connectible by engagement with each other and being manually separable and reusable for reconnection, but said strips fo said first type of fastening material are not adherent to each other and said strips of said second type of fastening material are not adherent to each other, said strips of first and second types of fastening material alternating around the periphery of each of said planar sheets such that separate sheets are manually connectible by placing edges of said sheets in engagement with first type of fastening material strips contacting second type of fastening material strips but without requiring precisely coplanar orientation of adjacent sheets nor edges of adjacent connected sheets to be precisely registered for a secure but manually disconnectible fastening of said separate sheets.

2. The kit defined in claim 1, in which the first type of fastening material is hook type material and the second type of fastening material is loop type fastening material.

3. The kit defined in claim 1, in which several of the sheets are in the shape of a first regular polygon, several of the sheets are in the shape of a second regular polygon and several of the sheets are in the shape of a third regular polygon.

* * * * *